US005403231A

United States Patent [19]

Duckworth

[11] Patent Number: 5,403,231

[45] Date of Patent: Apr. 4, 1995

[54] FAIRING MACHINE

[75] Inventor: Arnold Duckworth, 35 Cockleshell Ct., Runaway Bay, Queensland 4216, Australia

[73] Assignees: Arnold Duckworth, Queensland, Australia; Richard O'Meara, Newport, R.I.

[21] Appl. No.: 86,556

[22] Filed: Jul. 1, 1993

[30] Foreign Application Priority Data

Jun. 24, 1992 [AU] Australia ..... PL3105

[51] Int. Cl.[6] ..... B24B 23/00

[52] U.S. Cl. ..... 451/344; 451/359; 451/490

[58] Field of Search ..... 451/344, 353, 359, 456, 451/495, 529, 539, 490

[56] References Cited

U.S. PATENT DOCUMENTS

| | | | |
|---|---|---|---|
| 2,334,642 | 11/1943 | Moore | 51/397 |
| 3,880,047 | 4/1975 | Dosier | 51/273 |
| 3,882,644 | 5/1975 | Cusumano | 51/273 |
| 3,987,589 | 10/1976 | Marton | 51/273 |
| 4,646,480 | 3/1987 | Williams | 51/273 |
| 4,733,502 | 3/1988 | Braun | 51/407 |
| 4,765,099 | 8/1988 | Tanner | 51/273 |
| 4,986,703 | 1/1991 | Hampl et al. | 51/273 |
| 5,105,585 | 4/1992 | Hampl et al. | 51/273 |
| 5,237,781 | 8/1993 | Demetrius | 51/273 |

*Primary Examiner*—Maurina T. Rachuba
*Attorney, Agent, or Firm*—Lahive & Cockfield

[57] ABSTRACT

A powered fairing machine having a pair of flexible arms formed in a cross configuration with an abrasive material on their lower surfaces is described. A power source with a rotary output drive is connected to the intersection of the arms to impart a circular motion to them.

15 Claims, 3 Drawing Sheets

FAIRING MACHINE

This invention relates in general to an apparatus and method for sanding curved surfaces, and more particularly to an apparatus and method for power fairing of simple curved surfaces or compound surfaces.

BACKGROUND OF THE INVENTION

A flair surface is one which is free of bumps and hollows. Fairing is a sanding process that does not simply smooth a surface. Rather, it is a process which removes bumps or hollows from the surface being treated. It has application, for example, in the finishing of boat hulls which usually include a variety of compound curved surfaces. A variety of methods have been employed in smoothing the surface of hulls. These include rotary sanders, orbital sanders, random orbital sanders and the like. However, these perform simple smoothing functions and not, properly speaking, fairing functions. One device that has been used for fairing is called a long board. It consists of a relatively long, perhaps 3 feet, flexible board with sandpaper or other abrasive surface attached to its bottom surface and handles at either end. It is then worked by hand in a push pull motion or a diagonal motion to perform fairing. As is apparent, it is highly labor intensive and not entirely satisfactory in terms of performing the function.

It is a primary object of the present invention to provide a power head fairing apparatus to be used as a fairing tool, not only on simple curved surfaces, but also on compound curved surfaces.

SUMMARY OF THE INVENTION

Broadly speaking, the present invention employs a pair of crossed arms coupled to a high torque, relatively low speed, rotary drive power source, such as a hydraulic motor, with the crossed arms being formed as flexible arms or battens having extended, generally rectangular shaped, planar surfaces. The arms are capable of flexing in the direction perpendicular to the planar surface and the lower planar surface includes an abrasive covering, such as sandpaper. In this arrangement the arms can flex to conform to curved surfaces. The arms are coupled at a longitudinal position close to their midpoint at the cross intersection to the rotary output drive of a power source, such as a hydraulic motor, and the cross is driven in a circular motion to perform the fairing function. The operator holds the apparatus and guides it over the surface by means of handles attached to the power source.

In one configuration a second pair of cross arms are coupled to the rotary drive at a position displaced along the axis of rotation from the first pair of arms, to support the first pair of arms which have the abrasive coating. The second cross is general congruent with the first cross and has its outer ends fastened to the upper surfaces of the ends of the arms of the first cross.

DESCRIPTION OF PREFERRED EMBODIMENTS

Figure 1:
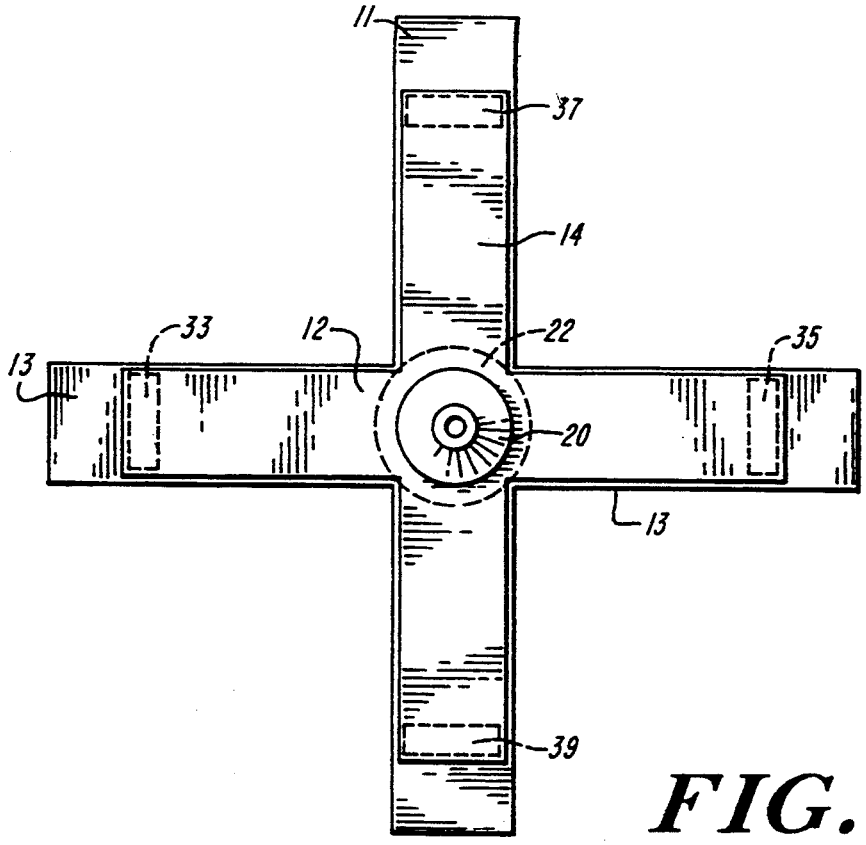
FIG. 1 is an illustration in plan view of a fairing apparatus constructed in accordance with the principles of this invention.

The fairing apparatus in FIG. 1 is suitable for fairing not only concave surfaces, but also convex and compound curved surfaces. It includes a first pair of generally rectangular arms 11 and 13 extended longitudinally and having planar lower surfaces 15 and 17. These arms 11 and 13 are formed in the configuration of a cross. A second pair of arms 12 and 14 are also formed in a cross configuration and are attached at their intersection to the rotary output drive 20 at a point displaced along the axis of rotation from the point of intersection of the first pair of arms 11 and 13. The rotary output drive 20 is powered by a high torque motor 22 (shown in phantom), or other suitable power source. The rotary drive output 20 may be formed, for example, with a key to lock with a slot in the shaft of the motor 22.

In the configuration shown, the first pair of arms 11 and 13 are maintained in a cross configuration by any suitable adhesive or mechanical structure (not shown). The outer terminal ends 11 and 13 are fastened, in the illustrated embodiment, to the second pair of arms 14 and 16 though flexible couplings 33, 35, 37 and 39. These flexible couplings may be formed of a material such as rubber pads. The couplings may be attached to the surfaces of the arms by means of a suitable epoxy adhesive. The lower surfaces 15 and 17 of the arms 11 and 13 carry a suitable abrasive such as sandpaper. Typical dimensions for arms 11 and 13 are a width of three inches, a thickness of one-eighth inches, and a length of twelve inches.

Figure 2:
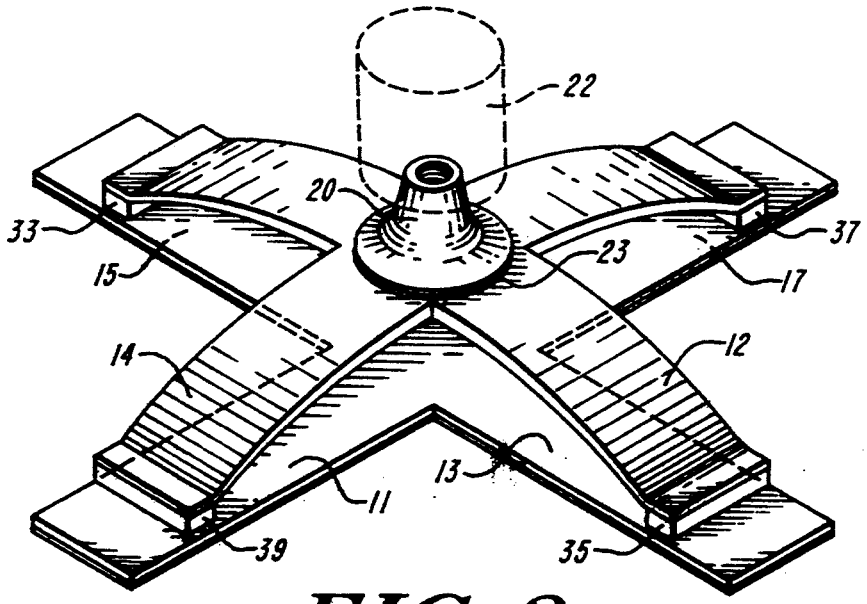
FIG. 2 is a side elevational view of the apparatus of FIG. 1.

While in the embodiment of FIGS. 1 and 2 flexible couplings have been employed, it will be realized that the second pair of arms 14 and 16 may be fastened directly to the first pair of arms 11 and 13, without intermediate resilient materials. The arms 11 and 13 are formed of suitable flexible materials rendering them flexible in the direction perpendicular to the planar surfaces 15 and 17, which carry the abrasive material. Suitable materials for these arms are plywood, other flexible boards, or a unidirectional glass fiber, epoxy composite. In the embodiment shown in FIGS. 1 and 2, flexible rubber pads are used to join the outer ends of the first pair of arms 11 and 13 to the second pair of arms 14 and 16, but, other suitable forms of fastening may be employed, provided that they do not extend below the abrasive surface to interfere with the fairing process. A suitable hydraulic motor for this application is a Char-Lynn "J" Series Motor. These motors are available from Eaton Hydraulic Division located at Eaton Prairie. Minn.

Figure 3:
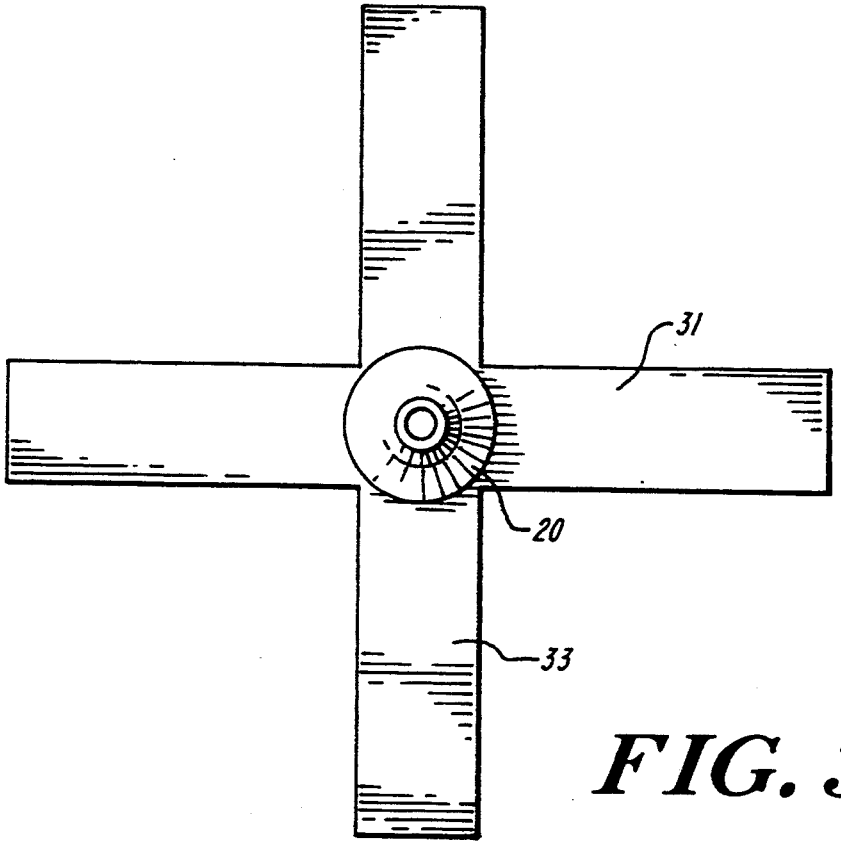
FIG. 3 is a plan view illustration of an embodiment of this invention suitable for fairing concave surfaces only.
Figure 3A:
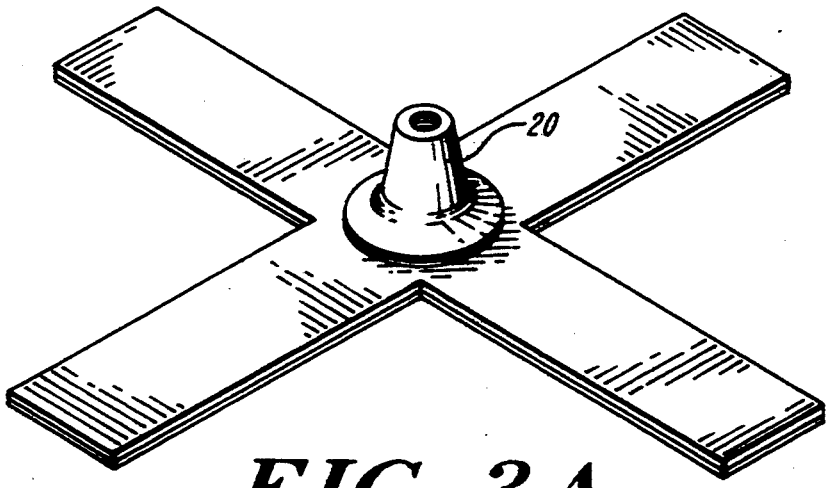
FIG. 3A is a side elevational view of the apparatus of FIG. 3.

In FIGS. 3 and 3A there is illustrated an embodiment which may be used for fairing concave surfaces only. Again, in this embodiment the arms 31 and 33 will be formed by a material that provides flexibility in the direction perpendicular to the planar surface of the arms. Because the apparatus is used only for fairing concave surfaces, the second pair of arms are not needed and the rotary drive output 20 is shown directly coupled to the arms.

Figure 4:
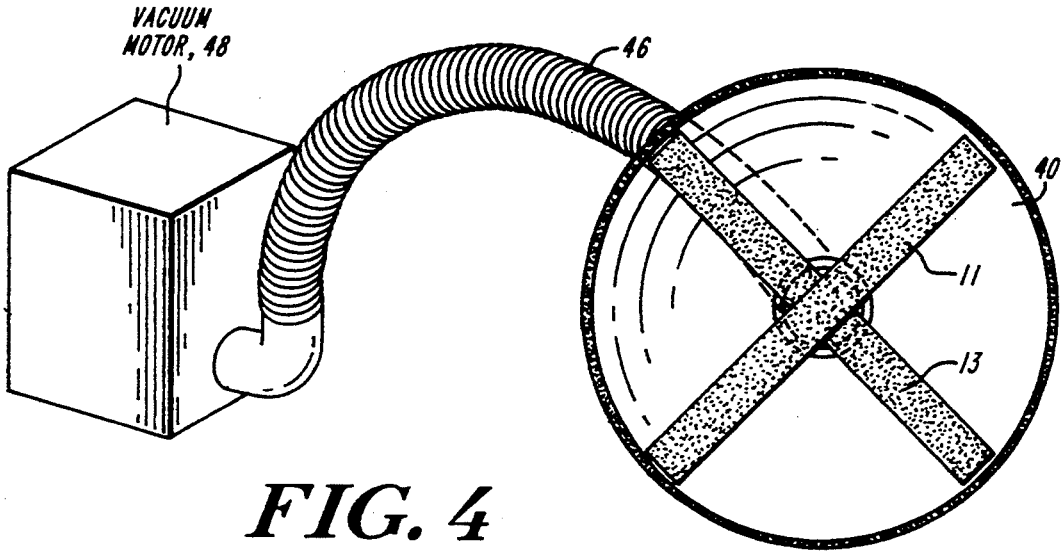
FIGS. 4 and 4A illustrate a second embodiment of this invention including an extraction dome and suction apparatus for removing material that is sanded from the curved surface during the fairing process.
Figure 4A:
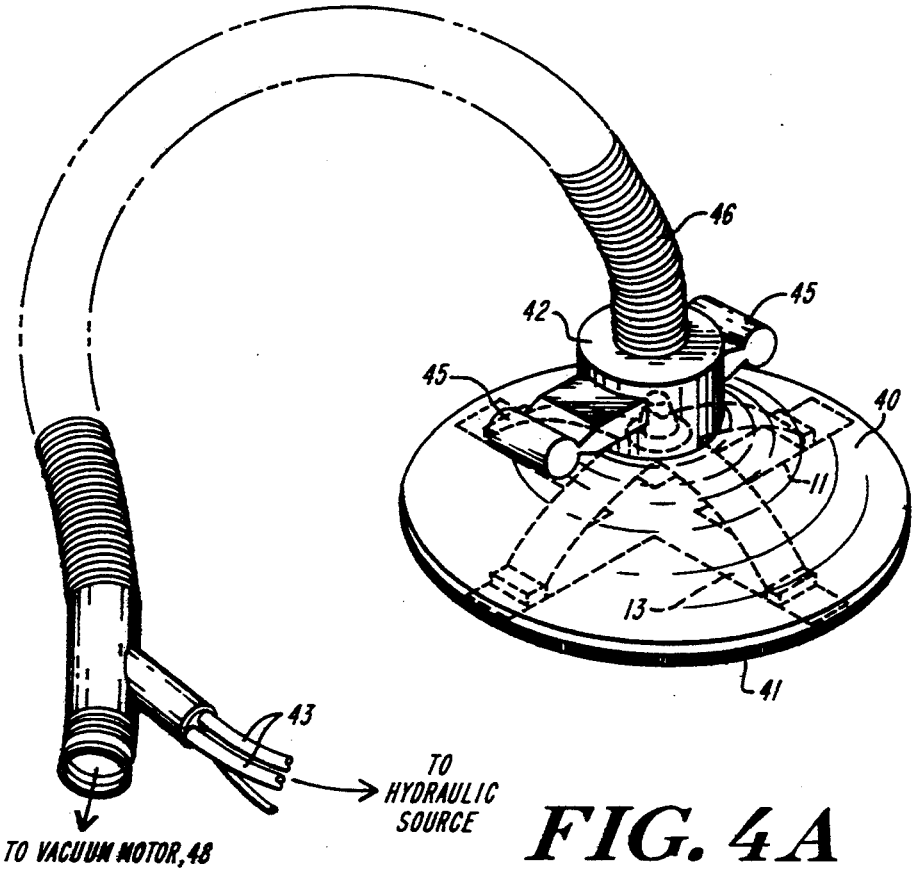

In FIGS. 4 and 4A, the fairing apparatus of FIGS. 1 and 2 is shown with a generally dish shaped cover 40 mounted to the motor housing 42, such that the cover does not rotate, but remains fixed with respect to that motor housing, allowing, therefore, the arms 11 and 13 to rotate. The cover 40 is fastened at its center to the housing 42, such as by a collar or other appropriate mechanical fixture. The motor housing 42 has gripping handles 45 on either side of it for manipulation of the entire sanding apparatus. The housing 42 is generally cylindrical, typically formed of either fiberglass or metal and has space around the enclosed hydraulic motor allowing for gas and entrained particulate material to pass from underneath the dome through the housing to a vacuum hose 46 connected to a suitable vacuum motor 48. The diameter of cover 40 is sufficient to extend beyond the outer ends of arms 11 and 13 in operation. The position of these arms may need to be adjusted to assure that the cover skin 41 extends to the work surface without interfering with the sanding process when the cover is flexed. The cover skirt 41 may be formed of a brush, thereby allowing air to pass through it without particulate material escaping. This arrangement then provides for extraction of the sanded material, thus providing for improved safety and health considerations, as well as cleanliness of the operation. Hydraulic hoses 43, which are coupled to the hydraulic motor pass out from the assembly through the vacuum hose 46. At a suitable point, such as ten feet removed from the cover, this hose may be divided in a Y-configuration, with one leg of the Y going to the vacuum motor 48 and the other carrying the hydraulic hoses going to a source of hydraulic pressure. The cover itself may be formed from a suitable light weight metal such as aluminum or a suitable thermoplastic material such as acrylonitrile butadiene styrene.

It will be understood that the invention is to be defined by the attached claims.

I claim:

1. A power operated apparatus for fairing a curved surface comprising, a power source providing a rotary output drive, a planar arm longitudinally extended along a first axis with an abrasive material covering one planar surface of said planar arm, said planar arm being flexible in a direction perpendicular to the plane of said arm to conform to said curved surface, said arm being coupled to said power source rotary output drive in such a way that rotational movement of said rotary output drive rotates said arm about an axis perpendicular to said first axis in the plane of its abrasive covered surface about a point approximately midway along said extended axis of said arm.

2. Apparatus in accordance with claim 1 and further including a second longitudinally extended planar arm coupled to said rotary output drive, said second arm being positioned at a substantial angle with respect to said first arm, in the plane of said abrasive surface, forming a cross configuration with said first arm, said second arm being flexible in the direction perpendicular to the plane of said arms.

3. Apparatus in accordance with any one of claims 1 or 2 wherein said power source is a hydraulic motor.

4. An apparatus in accordance with claim 2 wherein said second planar arm is fixed to have an angle substantially 90° in relation to said first planar arm in the plane of said first and second arms.

5. Apparatus in accordance with claim 1 wherein said abrasive surface is formed of sandpaper.

6. A power operated apparatus for fairing a curved surface comprising, a power source providing a rotary output drive, first and second planar arms each extended along a longitudinal axis, said first and second arms being positioned at a substantial angle to one another in the plane of said arms and intersecting to form a cross configuration, an abrasive material covering one planar surface of each of said first and second arms, said first and second arms being flexible in a direction perpendicular to the planes of said arms, third and fourth arms extended along the longitudinal axes of said arms and positioned to be generally congruent to said first and second arms, said third and fourth arms being coupled at their longitudinal midpoint to said rotary output drive at a position displaced along the axis of rotation from the intersection of said first and second arms, each of said third and fourth arms being coupled at its respective ends to corresponding ends of said first and second arms.

7. Apparatus in accordance with claim 6 wherein each of said third and fourth arms are coupled to said first and second arms through a resilient material.

8. Apparatus in accordance with claim 7 wherein said resilient material is rubber.

9. Apparatus in accordance with claim 1 and further including a cover having a diameter greater than the length of said planar arm, fixed to said power source in a fashion not to rotate with said output drive, said cover being formed as an inverted dish extending over said planar arm and toward said curved surface, means for applying suction to said cover to extract any material produced by sanding from the volume around said arm.

10. Apparatus in accordance with claim 9, wherein said cover is formed of a thermoplastic material.

11. Apparatus in accordance with claim 9 wherein said power source is a hydraulic motor.

12. Apparatus in accordance with claim 6 and further including a cover having a diameter greater than the length of said planar arms, fixed to said power source in a fashion not to rotate with said output drive, said cover being formed as an inverted dish extending over said planar arm and toward said curved surface, means for applying suction to said cover to extract any material produced by sanding from the volume around said arms.

13. Apparatus in accordance with claim 12, wherein said cover is formed of a thermoplastic material.

14. Apparatus in accordance with claim 13 wherein said power source is a hydraulic motor.

15. Apparatus in accordance with either of claims 9 or 12 and further including a brush fixed to the periphery of said cover to contact said curved surface to be faired.

* * * * *